US008499724B2

(12) United States Patent
Cho

(10) Patent No.: US 8,499,724 B2
(45) Date of Patent: Aug. 6, 2013

(54) ENGINE THAT IS PROVIDED WITH WATER PUMP

(75) Inventor: Changhyun Cho, Seoul (KR)

(73) Assignee: Hyundai Motor Company, Seoul (KR)

( * ) Notice: Subject to any disclaimer, the term of this patent is extended or adjusted under 35 U.S.C. 154(b) by 461 days.

(21) Appl. No.: 12/825,933

(22) Filed: Jun. 29, 2010

(65) Prior Publication Data

US 2011/0107984 A1 May 12, 2011

(30) Foreign Application Priority Data

Nov. 11, 2009 (KR) ..... 10-2009-0108615

(51) Int. Cl.
*F01P 5/10* (2006.01)
*F01P 7/14* (2006.01)

(52) U.S. Cl.
USPC ..... 123/41.44; 123/41.1

(58) Field of Classification Search
USPC ..... 123/41.08–41.1, 41.44–41.46
See application file for complete search history.

(56) References Cited

U.S. PATENT DOCUMENTS 2,390,279 A * 12/1945 Smith ..... 123/41.46
4,565,163 A * 1/1986 Ishimi et al. ..... 123/41.44

* cited by examiner

*Primary Examiner* — Noah Kamen
(74) *Attorney, Agent, or Firm* — Morgan, Lewis & Bockius LLP

(57) ABSTRACT

An engine that is equipped with a water pump, may include a pump housing that is mounted on one side of a cylinder block with an impeller rotatably mounted on a front side thereof to pump coolant, an inlet fitting that is mounted on the cylinder block at a predetermined distance from the pump housing such that the coolant flows through the inlet fitting, and a connecting body that integrally connects the pump housing with the inlet fitting to form one body.

12 Claims, 6 Drawing Sheets

ENGINE THAT IS PROVIDED WITH WATER PUMP

CROSS-REFERENCE TO RELATED APPLICATION

The present application claims priority to Korean Patent Application No. 10-2009-0108615 filed on Nov. 11, 2009, the entire contents of which is incorporated herein for all purposes by this reference.

BACKGROUND OF THE INVENTION

1. Field of the Invention

The present invention relates to an engine that is provided with a water pump. More particularly, the present invention relates to an engine that is provided with a water pump that is mounted on a cylinder block to circulate a coolant.

2. Description of Related Art cooling system of some kind is necessary in any internal combustion engine. If no cooling system was provided, parts would melt from the heat of the burning fuel and pistons would expand so much they would seize.

The cooling system includes a thermostat, a thermostat housing, an inlet fitting, an inlet fitting gasket, a water pump, a water pump gasket, and so on, and each of the components are assembled to a cylinder block or a cylinder head.

However, many kinds of components as stated above are mounted, and there are problems that the assembly efficiency is deteriorated and the manufacturing cost increases.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide an engine that is provided with a water pump having advantages of improving assembly efficiency and productivity.

So as to achieve the above object, an engine that is equipped with a water pump according to the present invention may include a pump housing that is mounted on one side of a cylinder block with an impeller rotatably mounted on a front side thereof to pump coolant, an inlet fitting that is mounted on the cylinder block at a predetermined distance from the pump housing such that the coolant flows through the inlet fitting, and a connecting body that integrally connects the pump housing with the inlet fitting to form one body.

The connecting body may monolithically connect the pump housing with the inlet fitting.

The engine may further include at least a supporting rod that integrally protrudes from the inlet fitting to the inner side of the cylinder block, a thermostat that is mounted on the at least a supporting rod to open or close a coolant passage of the inlet fitting according to a temperature of the coolant in the inlet fitting, and a fixing member that is mounted on a front end of the at least a supporting rod to fix the thermostat to the at least a supporting rod, wherein the thermostat is disposed between the inlet fitting and the fixing member, wherein the at least a supporting rod monolithically extends from the inlet fitting, wherein the front end of the at least a supporting rod is inserted into the fixing member and fixed thereto, and wherein the fixing member has a snap structure to be fixed to the at least a supporting rod.

In another aspect of the present invention, the engine may further include a gasket that is attached to front end surfaces of the pump housing, the connection body, and the inlet fitting, and a front surface of the cylinder block and the gasket is integrally formed to form one body.

The gasket may be monolithically formed.

An impeller hole may be formed in the gasket corresponding to the impeller, a thermostat hole may be formed in the gasket corresponding to the thermostat, and at least a mounting hole may be formed around the impeller hole and the thermostat hole in the gasket.

An impeller hole may be formed in the gasket corresponding to the impeller, and a step may be formed along a thermostat hole formed in the gasket corresponding to the thermostat, and an edge plate of the thermostat may be mounted on the step.

An impeller hole may be formed in the gasket corresponding to the impeller, a step may be formed along a thermostat hole formed in the gasket corresponding to the thermostat, and an edge plate of the thermostat may be mounted on the step, and one side surface of the edge plate may contact the front end surface of the inlet fitting, and the other surface thereof may contact the step of the gasket.

In further another aspect of the present invention, a cover may be disposed to the pump housing.

As stated above, a pump housing and an inlet fitting are integrally formed through a connecting body to improve assembly productivity of an engine that is provided with a water pump according to the present invention. Further, a gasket is also integrally formed. Thus, there is effectiveness in decreasing the number of components of an engine.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
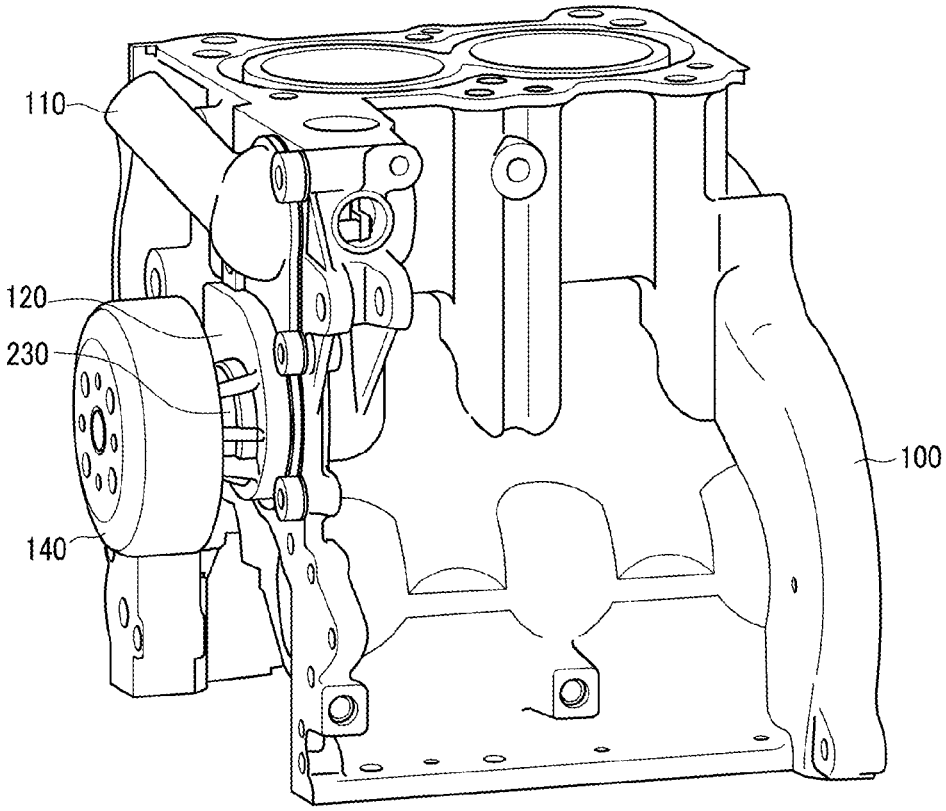
FIG. 1 is a perspective view of an engine that is provided with an exemplary water pump according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

FIG. 1 is a perspective view of an engine that is provided with a water pump according to an exemplary embodiment of the present invention.

Referring to FIG. 1, an engine that is provided with a water pump includes a cylinder block 100, a pump housing 230, a connecting body 120, an inlet fitting 110, and a cover 140.

The pump housing 230, the connecting body 120, and the inlet fitting 110 are mounted on one side of the cylinder block 100, and the pump housing 230, the inlet fitting 110, and the connecting body 120 are integrally formed to have one body. Further, the cover 140 protects the pump housing 230.

Figure 2:
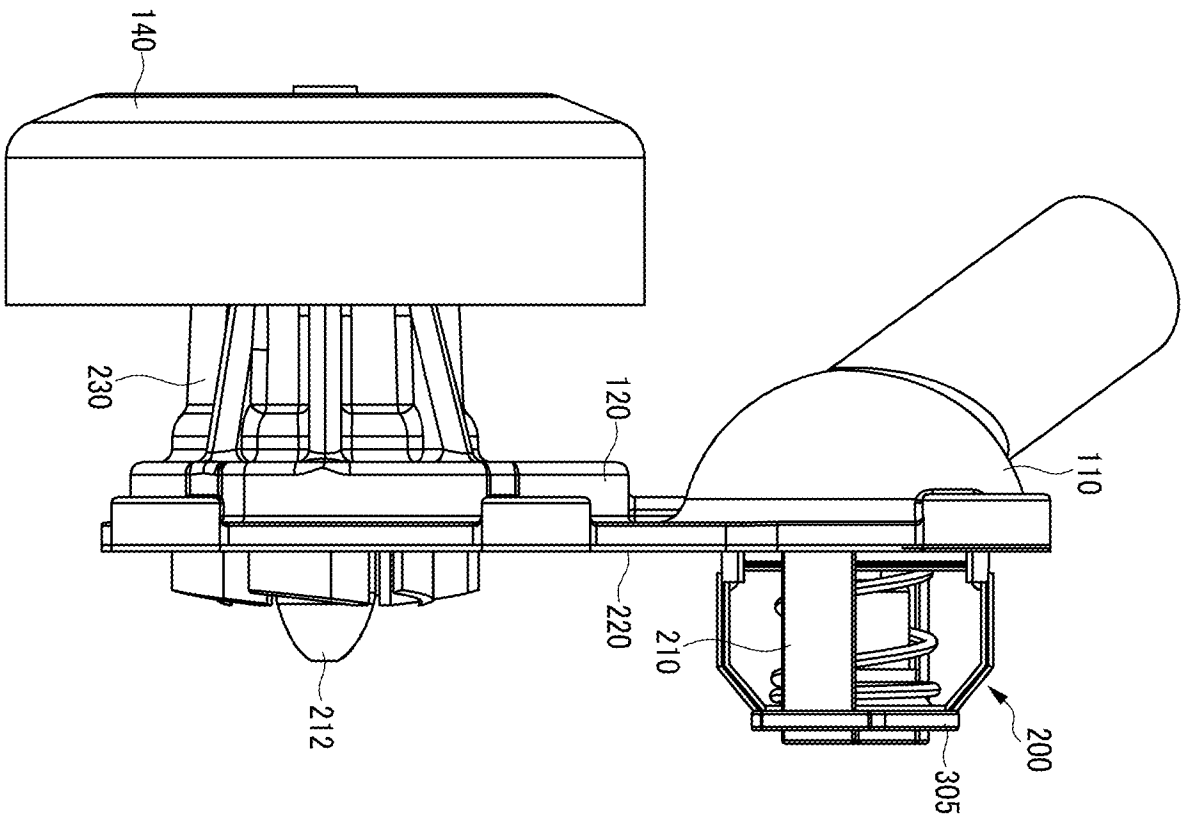
FIG. 2 is a front view of an exemplary inlet fitting and a exemplary water pump that are mounted on an engine according to the present invention.

An impeller 212 of FIG. 2, which is built into the pump housing 230, pumps the coolant, and the coolant is circulated through the inlet fitting 110. A thermostat 200 of FIG. 2 is built into the inlet fitting 110, and the thermostat 200 opens or closes a coolant passage 400 of FIG. 4 depending on the temperature of the coolant in the inlet fitting 110.

FIG. 2 is a front view of an inlet fitting and a water pump that are mounted on an engine according to an exemplary embodiment of the present invention.

Referring to FIG. 2, the pump housing 230 is formed at a lower portion, the inlet fitting 110 is formed at a predetermined distance from the pump housing, and the connecting body 120 integrally connects the pump housing 230 and the inlet fitting 110. That is, the pump housing 230, the connecting body 120, and the inlet fitting 110 are integrally formed to have one body.

A gasket 220 is disposed to contact a front end surface of the pump housing 230, the connecting body 120, and the inlet fitting 110. The gasket 220 seals between the cylinder block 100 and the inlet fitting 110, the connecting body 120, and the pump housing 230.

The impeller 212 is rotatably mounted at a front end portion of the pump housing 230 to pump the coolant through rotation thereof.

A supporting rod 210 protrudes at a front end portion of the inlet fitting 110, and the supporting rod 210 is integrally formed with the inlet fitting 110.

The thermostat 200 is mounted on the supporting rod 210, and a fixing member 305 is mounted on an end portion of the supporting rod 210. The fixing member 305 fixes the thermostat 200 on the supporting rod 210 and the inlet fitting 110.

Figure 3:
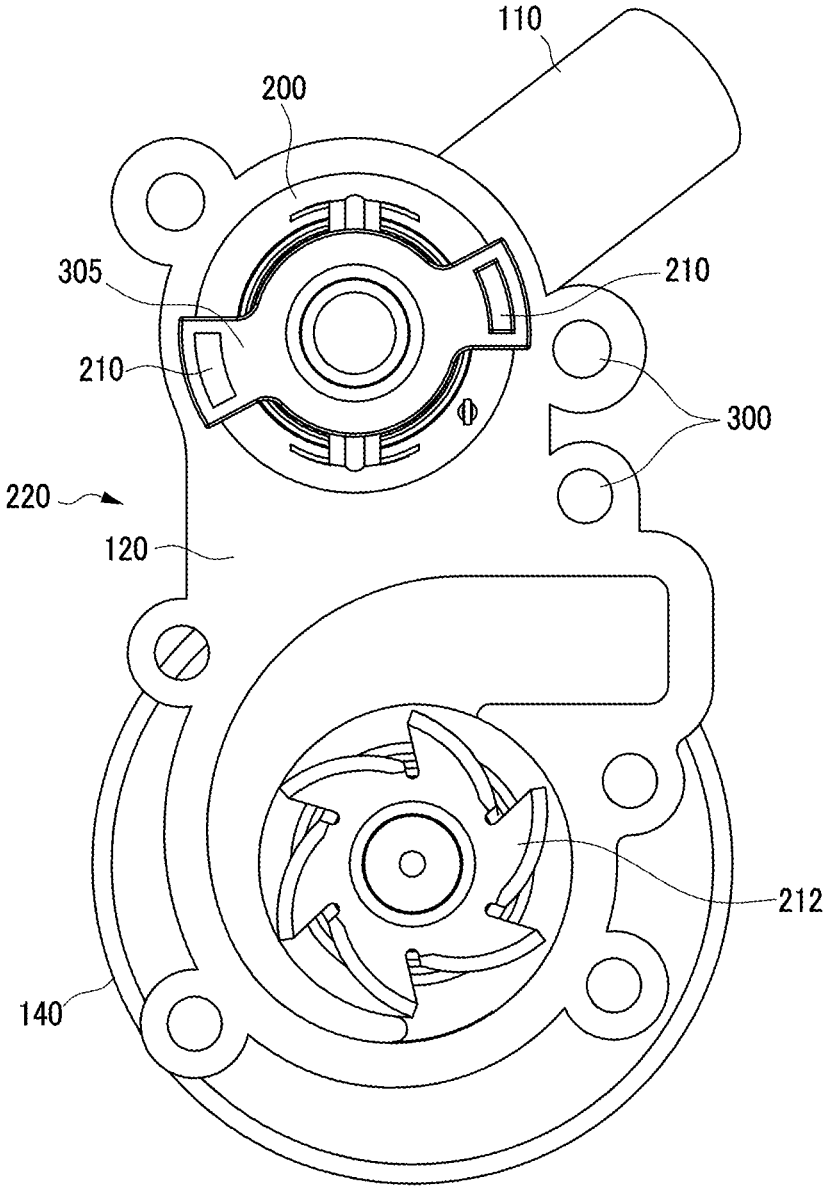
FIG. 3 is a side view of an exemplary inlet fitting and an exemplary water pump that are mounted on an engine according to the present invention.

FIG. 3 is a side view of an inlet fitting and a water pump that are mounted on an engine according to an exemplary embodiment of the present invention.

Referring to FIG. 3, supporting rods 210 protrude at both sides of the inlet fitting 110, and the thermostat 200 is disposed between the supporting rods 210.

In this case, two supporting rods 210 penetrate both sides of the fixing member 305 to be mounted to the fixing member 305. Further, the fixing member 305 has a snap structure to be fixed to the supporting rods 210.

Figure 4:
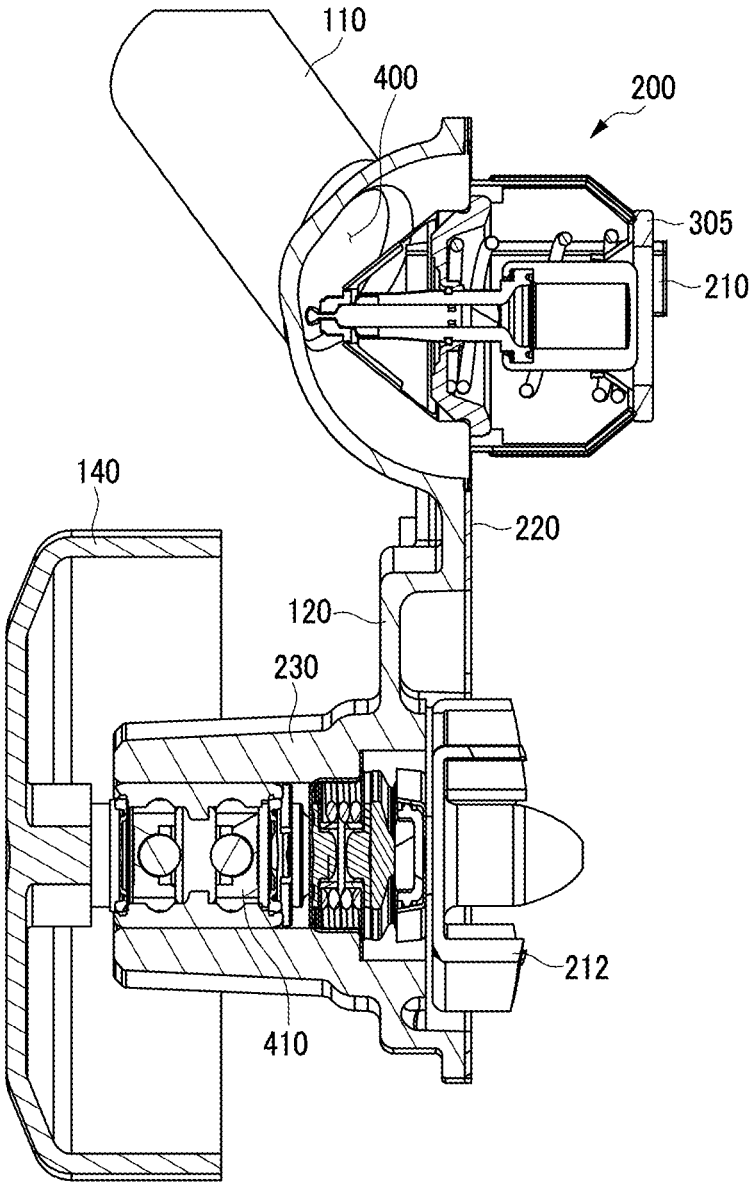
FIG. 4 is a cross-sectional view of an exemplary inlet fitting and an exemplary water pump that are mounted on an engine according to the present invention.

FIG. 4 is a cross-sectional view of an inlet fitting and a water pump that are mounted on an engine according to an exemplary embodiment of the present invention.

Referring to FIG. 4, the thermostat 200 is mounted on the supporting rods 210 by the fixing member 305 so as to open/close the coolant passage 400 of the inlet fitting 110.

A drive portion 410 is built into the pump housing 230, and the drive portion 410 rotates the impeller that is mounted on a front end portion thereof under a predetermined condition.

In an exemplary embodiment of the present invention, the drive portion 410 can be operated by an electric motor or torque of a crankshaft.

Figure 5:
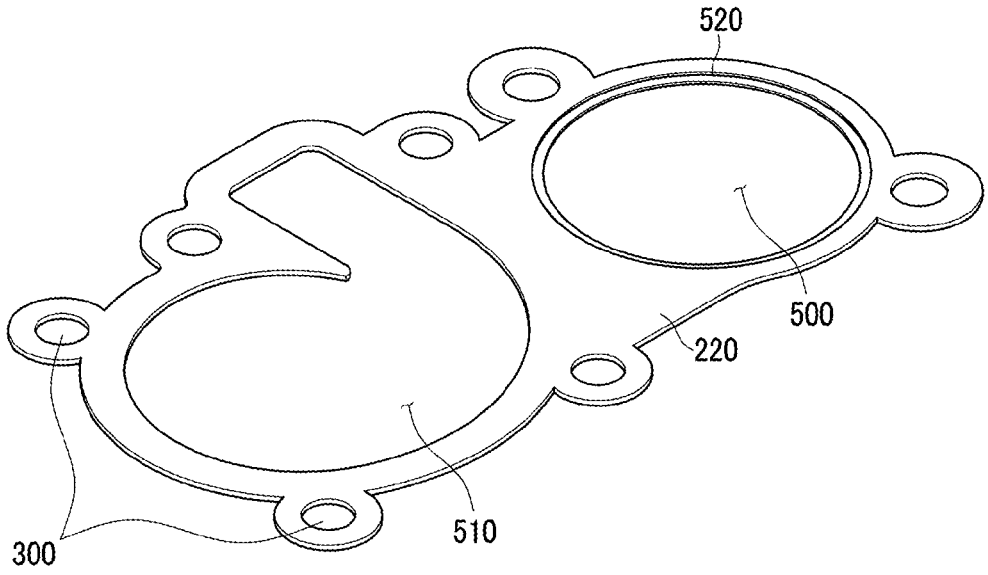
FIG. 5 is a perspective view of a gasket that is mounted on an exemplary inlet fitting and an exemplary water pump according to the present invention.

FIG. 5 is a perspective view of a gasket that is mounted on an inlet fitting and a water pump according to an exemplary embodiment of the present invention.

Referring to FIG. 5, an impeller hole 510 corresponding to the impeller 212 and a thermostat hole 500 corresponding to the thermostat 200 that is mounted in the inlet fitting 110 are formed in the gasket 220.

The pump housing 230, the connecting body 120, and the inlet fitting 110 are an integrally formed body, and the gasket 220 that is interposed between the cylinder block 100 and the integrally formed body is also integrally formed such that assembly efficiency and productivity are improved.

Referring to FIG. 5, a step 520 is formed along the thermostat hole 500 that is formed in the gasket 220. One side surface of the edge of the thermostat 200 contacts the surface of the step 520, and the detailed structure thereof is explained referring to FIG. 6.

Figure 6:
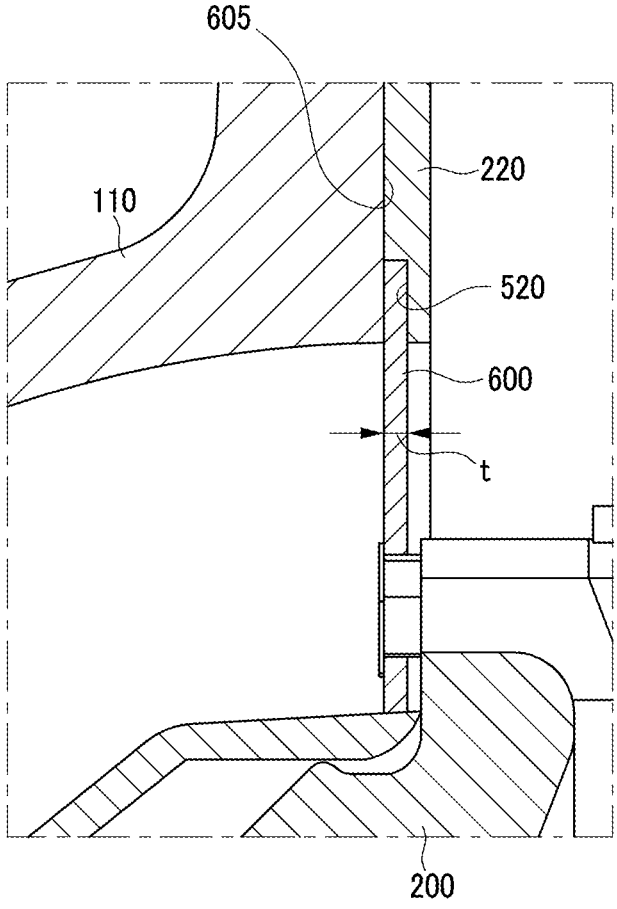
FIG. 6 is a cross-sectional view of an exemplary inlet fitting and an exemplary water pump according to the present invention.

FIG. 6 is a cross-sectional view of an inlet fitting and a water pump according to an exemplary embodiment of the present invention.

Referring to FIG. 6, an edge plate 600 of the thermostat 200 and the gasket 220 contact a front end surface 605 of the inlet fitting 110.

The thickness of the edge plate 600 of the thermostat 200 is the same as the depth of the step 520 of the gasket 220, and one side surface of the gasket 220 contacts the front end surface of the inlet fitting 110 and the other side surface of the gasket 220 contacts the cylinder block 100.

Referring to FIG. 3 and FIG. 5, a fixing bolt is inserted through a mounting holes 300 that are formed in the connecting body 120 and the gasket 220 such that the pump housing 230, the connecting body 120, and the inlet fitting 110 are integrally fixed to the cylinder block 100.

For convenience in explanation and accurate definition in the appended claims, the terms "lower" and "front" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine that is equipped with a water pump, comprising:

a pump housing that is mounted on one side of a cylinder block with an impeller rotatably mounted on a front side thereof to pump coolant;

an inlet fitting that is mounted on the cylinder block at a predetermined distance from the pump housing such that the coolant flows through the inlet fitting;

a connecting body that integrally connects the pump housing with the inlet fitting to form one body;

at least a supporting rod that integrally protrudes from the inlet fitting to the inner side of the cylinder block;

a thermostat that is mounted on the at least a supporting rod to open or close a coolant passage of the inlet fitting according to a temperature of the coolant in the inlet fitting; and a fixing member that is mounted on a front end of the at least a supporting rod to fix the thermostat to the at least a supporting rod.

2. The engine of claim 1, wherein the connecting body monolithically connects the pump housing with the inlet fitting.

3. The engine of claim 1, wherein the thermostat is disposed between the inlet fitting and the fixing member.

4. The engine of claim 1, wherein the at least a supporting rod monolithically extends from the inlet fitting.

5. The engine of claim 1, wherein the front end of the at least a supporting rod is inserted into the fixing member and fixed thereto.

6. The engine of claim 5, wherein the fixing member has a snap structure to be fixed to the at least a supporting rod.

7. The engine of claim 1, wherein a cover is disposed to the pump housing.

8. An engine that is equipped with a water pump, comprising:

a pump housing that is mounted on one side of a cylinder block with an impeller rotatably mounted on a front side thereof to pump coolant;

an inlet fitting that is mounted on the cylinder block at a predetermined distance from the pump housing such that the coolant flows through the inlet fitting;

a connecting body that integrally connects the pump housing with the inlet fitting to form one body; and a gasket that is attached to front end surfaces of the pump housing, the connection body, and the inlet fitting, and a front surface of the cylinder block and the gasket is integrally formed to form one body.

9. The engine of claim 8, wherein the gasket is monolithically formed.

10. The engine of claim 8, wherein an impeller hole is formed in the gasket corresponding to the impeller, a thermostat hole is formed in the gasket corresponding to the thermostat, and at least a mounting hole is formed around the impeller hole and the thermostat hole in the gasket.

11. The engine of claim 8, wherein an impeller hole is formed in the gasket corresponding to the impeller, and a step is formed along a thermostat hole formed in the gasket corresponding to the thermostat, and an edge plate of the thermostat is mounted on the step.

12. The engine of claim 8, wherein an impeller hole is formed in the gasket corresponding to the impeller, a step is formed along a thermostat hole formed in the gasket corresponding to the thermostat, and an edge plate of the thermostat is mounted on the step, and one side surface of the edge plate contacts the front end surface of the inlet fitting, and the other surface thereof contacts the step of the gasket.

* * * * *